US006171546B1

(12) United States Patent
Mårs et al.

(10) Patent No.: US 6,171,546 B1
(45) Date of Patent: Jan. 9, 2001

(54) POWDER METALLURGICAL BODY WITH COMPACTED SURFACE

(75) Inventors: Owe Mårs, Viken; Nils Carlbaum, Ödåkra, both of (SE)

(73) Assignee: Höganäs AB, Höganäs (SE)

( * ) Notice: Under 35 U.S.C. 154(b), the term of this patent shall be extended for 0 days.

(21) Appl. No.: 09/208,499

(22) Filed: Dec. 10, 1998

Related U.S. Application Data

(63) Continuation of application No. PCT/SE97/01027, filed on Jun. 12, 1997.

(30) Foreign Application Priority Data

Jun. 14, 1996 (SE) ..... 9602376

(51) Int. Cl.[7] ..... B22F 3/12; B22F 7/02
(52) U.S. Cl. ..... 419/38; 419/55
(58) Field of Search ..... 419/38, 55

(56) References Cited

U.S. PATENT DOCUMENTS

| | | | | |
|---|---|---|---|---|
| 3,874,049 | * | 4/1975 | Ferguson | 29/149.5 DP |
| 4,059,879 | * | 11/1977 | Chmura et al. | 29/148.4 R |
| 5,009,842 | * | 4/1991 | Hendrickson et al. | 419/28 |
| 5,512,236 | * | 4/1996 | Jones et al. | 419/28 |
| 5,711,187 | * | 1/1998 | Cole et al. | 74/434 |
| 5,729,822 | * | 3/1998 | Shivanath et al. | 428/551 |
| 5,972,132 | * | 1/2000 | Cadle | 148/514 |
| 6,013,225 | * | 1/2000 | Cadle et al. | 419/29 |

FOREIGN PATENT DOCUMENTS

| | | | |
|---|---|---|---|
| 2250227 | * | 6/1992 | (GB) . |
| 61-261402 | | 11/1986 | (JP) . |
| 61-264101 | | 11/1986 | (JP) . |
| 7-100629 | | 4/1995 | (JP) . |
| 435026 | | 3/1984 | (SE) . |
| WO92/05897 | | 4/1992 | (WO) . |
| WO94/14557 | | 7/1994 | (WO) . |

OTHER PUBLICATIONS

"Application of Uniaxial Pressure—Compression of Prismatic Compacts", *Treatise on Powder Metallurgy*, Claus G. Goetzel, Ph.D., vol. I, Interscience Publishers, Inc., New York, 1949, pp. 316–318.

"Process Controls the Key to Reliability of Shot Peening", J. Mogul et al., *Industrial Heating,* No. 11 (Nov. 1995) pp. 34–35.

* cited by examiner

*Primary Examiner*—Daniel J. Jenkins
(74) *Attorney, Agent, or Firm*—Burns, Doane, Swecker & Mathis, L.L.P.

(57) ABSTRACT

The present invention concerns compacted and optionally presintered bodies, which are prepared from metal powders and which have densified surfaces, obtained by shot peening or rolling.

20 Claims, 3 Drawing Sheets

POWDER METALLURGICAL BODY WITH COMPACTED SURFACE

This is a continuation of International Application No. PCT/SE97/01027, filed Jun. 12, 1997, which designates the United States of America and claims priority from Swedish Application No. 9602376-7, filed Jun. 14, 1996.

FIELD OF THE INVENTION

The present invention concerns compacted bodies and more particularly compacted and optionally presintered bodies, which are prepared from metal powders and which have a densified surface.

BACKGROUND OF THE INVENTION

Materials used for components subjected to a bending stress e.g. gear wheels are subjected to local stress concentrations, and it is preferred that these materials have superior properties at the local stress maximum regions.

An example of such a material is disclosed in EP 552 272 which concerns sintered powder metal blanks having densified surface regions. According to this publication the densified regions are obtained by rolling.

It is also known that the surfaces of sintered powder metallurgical parts can be densified by using shot peening. The purpose of shot peening the surfaces of these sintered parts is to induce compressive stress in the surfaces, which in turn results in sintered parts having improved fatigue strength, surface hardness etc.

SUMMARY OF THE INVENTION

It has now been found that important advantages can be obtained if the densification of the surface is performed before the sintering of the compacted parts. The most interesting results have been obtained when the compacted parts are subjected to the densification process after a presintering step. Accordingly, the present invention concerns a process for preparing compacted and preferably presintered bodies having a densified surface as well as the bodies obtained by this process.

DETAILED DESCRIPTION OF THE INVENTION

Figure 1:
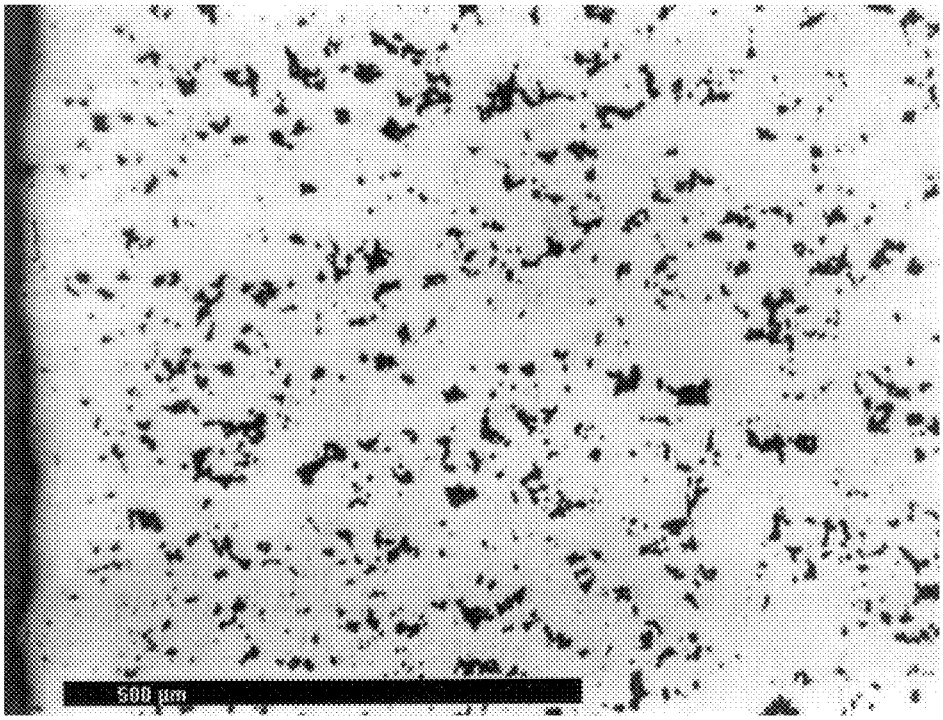
FIG. 1 is a photomicrograph at 120x of an unetched green sample compacted in a lubricated die at 700 MPa followed by shot peening at an Almen intensity of 0.13 for 1.5 seconds.

By performing the densification of metal powder bodies in green and optionally presintered condition, a larger degree of deformation can be obtained than in the case where sintered bodies are densified. When the green and optionally presintered parts are subsequently sintered, the previous pores are sintered together and a layer with full or almost full density is created. In this context the term "full or almost full density" is intended to mean that a densification in the range of 90–100 percent of full density is established.

By using the process according to the present invention not only the densification or deformation depth will be improved. Also the energy requirement will be considerably lower than when the densification process is carried out after the sintering step in accordance with known methods. After sintering the bodies prepared according to the present invention can be treated with secondary operations as usual.

Suitable metal powders which can be used as starting materials for the compacting process are powders prepared from metals such as iron and nickel. In the case of iron-based powders, alloying elements, such as carbon, chromium, manganese, molybdenum, copper, nickel, phosphorus, sulphur, etc. can be added in order to modify the properties of the final sintered products. The iron-based powders can be selected from the group consisting of substantially pure iron particles, pre-alloyed iron-based particles, diffusion-alloyed iron-based particles and mixtures of iron particles and alloying elements.

In order to obtain sufficient bending strength for the subsequent densification process the starting metal powder is uniaxially compacted at a pressure between 200 and 1200, preferably between 400 and 900 MPa. The compaction is preferably carried out in a lubricated die. Other types of compaction are warm and cold compaction of metal powders mixed with lubricants, such as stearates, waxes, metal soaps, polymers, etc.

According to a preferred embodiment of the invention the compacted body is also presintered at a temperature above 500° C., preferably between 650 and 1000° C. before the densification operation.

The green and optionally presintered bodies subjected to the densification process according to the present invention should be compacted and optionally presintered to a minimum bending strength of at least 15 MPa, preferably at least 20 MPa, and most preferably at least 25 MPa.

The densification process according to the invention is preferably carried out by shot peening although other densification processes such as different types of rolling are not excluded. In shot peening, rounded or essentially spherical particles (termed "shot") made from cast or wrought steel and stainless steel, as well as from ceramic or glass beads, are propelled against a workpiece with sufficient energy and for a sufficient time to cover the surface with overlapping cold worked dimples (see e.g. the article by J. Mogul et al "Process controls the key to reliability of shot peening", Process Controls & Instrumentation, November 1995).

The shot peening time according to the present invention normally exceeds 0.5 seconds and is preferably between 1 and 5 seconds and the Almen intensity is normally in the range 0.05–0.5. The deformation depth depends on the final use of the product and should exceed 0.1 mm, preferably 0.2 mm and most preferably the depth should exceed 0.3 mm.

The invention is illustrated by the following non-limiting examples.

The starting metal powder was Distaloy DC-1, which is an iron-based powder containing 2% nickel and 1.5% molybdenum available from Höganäs AB, Sweden.

This powder was warm compacted at 700 MPa to a density of 7.4 g/cm$^3$ having a bending strength of 25 MPa. The compacted bodies were divided into the following three groups:

Group 1 The bodies were left green, i e not subjected to any additional treatment.

Group 2 The bodies were presintered at 750° C. for 20 minutes in protective atmosphere.

Group 3 The bodies were sintered at 1120° C. for 15 minutes in endogas.

GROUP 1

The green bodies were shot peened. At too high intensities, i.e. Almen intensities (cf the Mogul article referred to above) above 0.14 for 3 seconds, the particles were torn loose and the surface was destroyed. It turned out that the Almen intensities should be below about 0.14 and the exposure time should be less than 2 seconds. This was true for both green bodies which had been warm compacted and for bodies which were produced in a lubricated die. As can be seen in FIGS. 1–6, the densification was somewhat better in the bodies obtained when the compaction was performed in a lubricated die.

GROUP 2

The presintering of the green bodies was done in order to remove lubricant that could create porosity, to remove deformation hardening and to improve the strength of the material. It was essential that the graphite difusion was limited in order to avoid solution hardening effects in the iron powder particles. After the presintering, the strength of the material had improved significantly and much higher Almen intensities could be used, especially for the bodies manufactured in lubricated dies. Almen intensities up to 0.3 could be used without problems, i.e. no particles were torn loose from the surface, and deformation depths of 300 μm were achieved. For the warm compacted bodies the erosion started at intensities of 0.14. Due to the removal of lubricant and deformation hardening, the deformation depth had increased significantly in comparison with the green bodies of group 1.

GROUP 3

Only warm pressed materials were tested as no significant pore structure difference from various compacting methods is considered to remain after a full sintering operation. The sintered body had their full strength, and therefore very high Almen intensities, up to 0.3, could be used. The effect of the shot peening operation is, however, much less in comparison with the bodies which were shot peened in green or presintered condition according to the present invention. It can be seen that only one third of the deformation depth was achieved at the same intensity due to the high hardness of the presintered body.

The experiments are listed in the following table.

Figure 2:
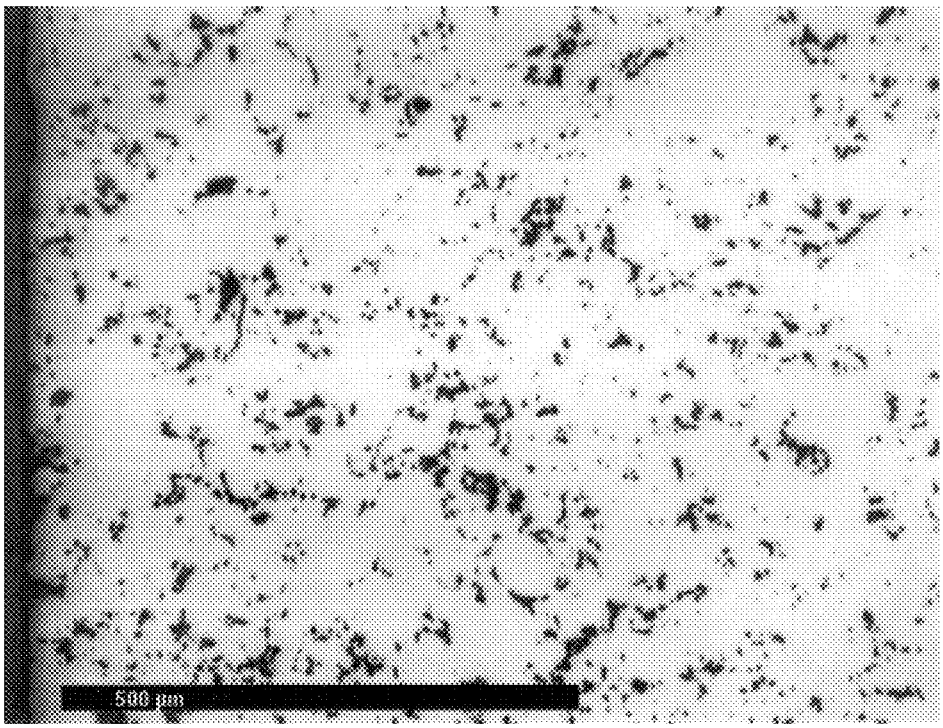
FIG. 2 is a photomicrograph at 120x of an unetched presintered sample compacted in a die at 700 MPa followed by shot peening at an Almen intensity of 0.14 for 1.5 seconds.
Figure 3:
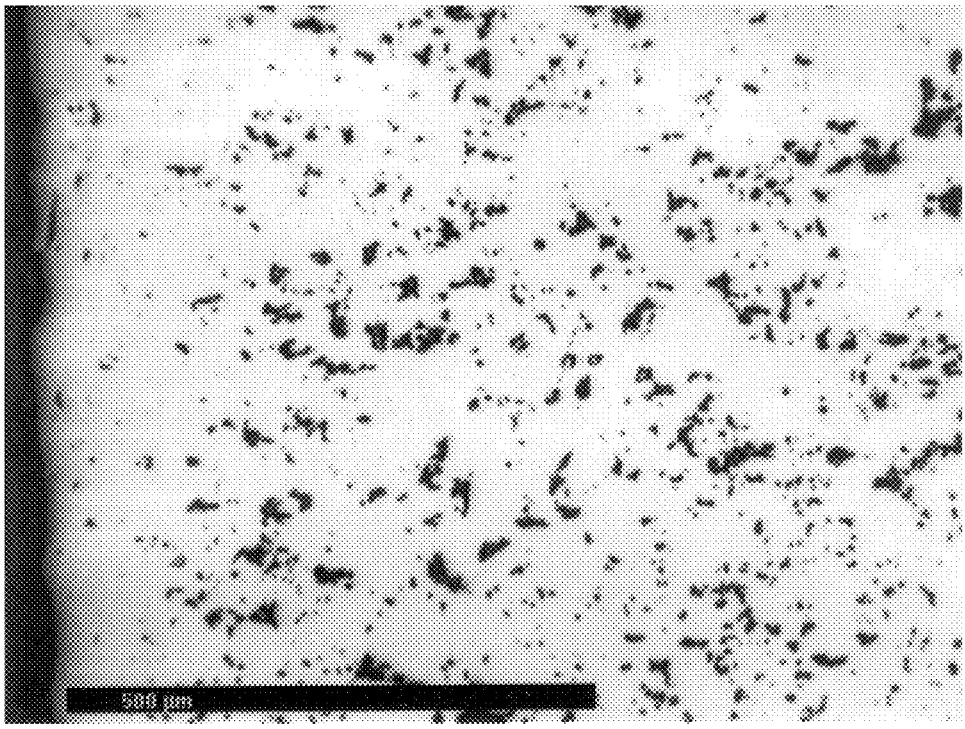
FIG. 3 is a photomicrograph at 120x of an unetched presintered sample compacted in a lubricated die at 700 MPa by shot peening at an Almen intensity of 0.21 for 3 seconds.
Figure 4:
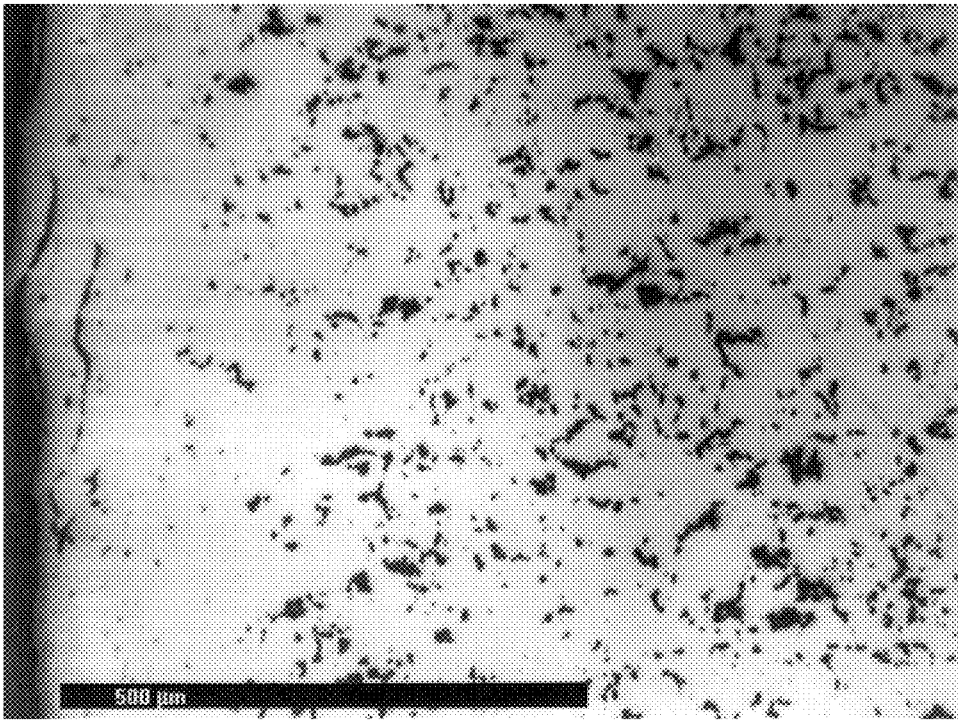
FIG. 4 is a photomicrograph at 120x of an unetched presintered sample compacted in a lubricated die at 700 MPa followed by shot peening at an Almen intensity of 0.3 for 3 seconds.
Figure 5:
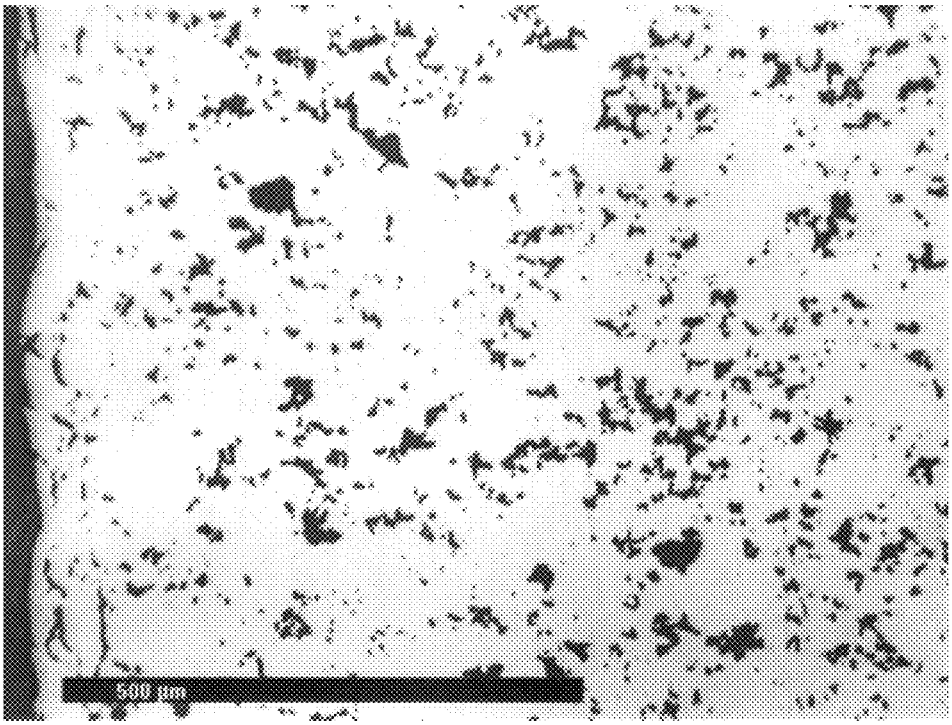
FIG. 5 is a photomircrograph at 120x an unetched green sample compacted in a die at 700 MPa followed by shot peening at an Almen intensity of 0.08 for 1.5 seconds.
Figure 6:
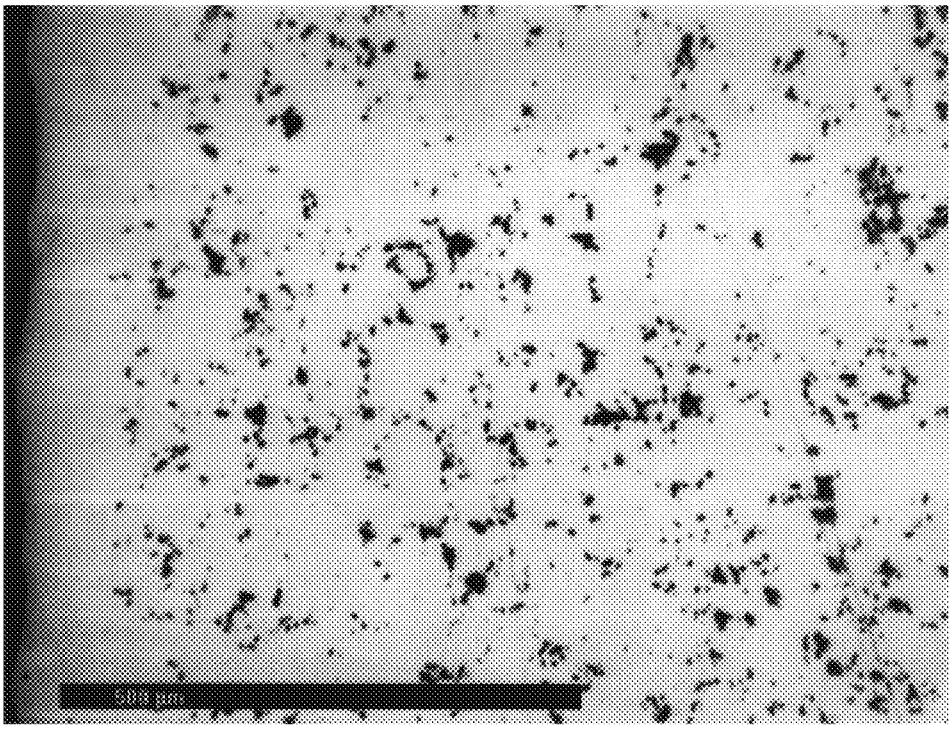
FIG. 6 is a photomicrograph at 120x of an unetched sintered (1120° C.) sample compacted in a die at 700 MPa followed by shot peening at an Almen intensity of 0.3 for 3 seconds.

| Compaction | Sintering | Shot Peening Time/ Almen Intensity | Deformation depth | FIG. |
|---|---|---|---|---|
| Lubricated Die | Green | 1.5 s/0.08 | 50 μm | |
| Lubricated Die | Green | 1.5 s/0.13 | 100 μm | FIG. 1 |
| Warm Compacted | Green | 1.5 s/0.08 | 30 μm | FIG. 5 |
| Warm Compacted | Green | 1.5 s/0.13 | 30–50 μm | |
| Lubricated Die | Presintered | 3 s/0.17 | 200 μm | |
| Lubricated Die | Presintered | 3 s/0.21 | 250 μm | FIG. 3 |
| Lubricated Die | Presintered | 3 s/0.30 | 300 μm | FIG. 4 |
| Warm Compacted | Presintered | 1.5 s/0.13 | 200 μm | |
| Warm Compacted | Presintered | 1.5 s/0.14 | 200 μm | FIG. 2 |
| Warm Compacted | Sintered | 3 s /0.17 | 70 μm | |
| Warm Compacted | Sintered | 3 s/0.21 | 100 μm | |
| Warm Compacted | Sintered | 3 s/0.30 | 130 μm | FIG. 6 |

What is claimed is:

1. Process for the preparation of a powder metallurgical body characterised by the steps of unaxially compacting metal powder;

subjecting the obtained body to shot peening or rolling at an intensity and for a period of time sufficient for establishing a densification surface layer in the range of 90 to 100 percent of full density within a deformation depth of at least 0.1 mm;

optionally subjecting the obtained body to an additional compacting step; and sintering the surface densified body.

2. Process according to claim 1, characterised in that the compacted body is presintered at a temperature of at least 500° C. before shot peening or rolling.

3. Process according to claim 2, characterised in that the metal powder is an iron-based powder.

4. Process according to claim 3, characterised in that the iron-based powder includes one or more elements selected from the group consisting of C, Cr, Mn, Mo, Cu, Ni, P, V, S, B, Nb, Ta, N and inevitable impurities in addition to Fe.

5. Process according to claim 2, characterised in that the iron-based powder is selected from the group consisting of substantially pure iron particles, pre-alloyed iron-based particles, diffusion alloyed iron-based particles and mixtures of iron particles and alloying elements.

6. Process according to claim 1, characterised in that the powder is unaxially compacted and presintered to a bending strength of at least 15 MPa.

7. Process according to claim 2, characterised in that the powder is unaxially compacted and presintered to a bending strength of at least 15 Mpa.

8. Process according to claim 3, characterised in that the powder is unaxially compacted and presintered to a bending strength of at least 15 Mpa.

9. Process according to claim 4, characterised in that the powder is unaxially compacted and presintered to a bending strength of at least 15 Mpa.

10. Process according to claim 5, characterised in that the powder is unaxially compacted and presintered to a bending strength of at least 15 Mpa.

11. Process according to claim 1, wherein a deformation depth of at least 0.2 mm is achieved in said surface densification layer.

12. Process according to claim 1, wherein the compacted powder is presintered to a bending strength of at least 20 MPa.

13. Process according to claim 1, wherein the compacted powder is presintered to a bending strength of at least 25 MPa.

14. Process according to claim 2, wherein the compacted powder is presintered to a bending strength of at least 20 MPa.

15. Process according to claim 2, wherein the compacted powder is presintered to a bending strength of at least 25 MPa.

16. Process according to claim 3, wherein the compacted powder is presintered to a bending strength of at least 20 MPa.

17. Process according to claim 3, wherein the compacted powder is presintered to a bending strength of at least 25 MPa.

18. Process according to claim 4, wherein the compacted powder is presintered to a bending strength of at least 20 MPa.

19. Process according to claim 4, wherein the compacted powder is presintered to a bending strength of at least 25 MPa.

20. Process according to claim 5, wherein the compacted powder is presintered to a bending strength of at least 25 MPa.

* * * * *